US006557563B2

(12) United States Patent
Ohba

(10) Patent No.: US 6,557,563 B2
(45) **Date of Patent: *May 6, 2003**

(54) STICK TYPE COSMETIC MATERIAL FEEDING CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/848,234

(22) Filed: May 4, 2001

(65) Prior Publication Data

US 2002/0053352 A1 May 9, 2002

(30) Foreign Application Priority Data

Nov. 8, 2000 (JP) ..... 2000-340110

(51) Int. Cl.[7] ..... A45D 40/24; A45D 40/26; A45D 40/04

(52) U.S. Cl. ..... 132/318; 132/218; 401/68; 401/75

(58) Field of Search ..... 132/318, 218, 132/317, 320; 401/68, 75, 79, 62, 70, 76, 86, 87, 172, 174

(56) References Cited

U.S. PATENT DOCUMENTS

| | | | | | |
|---|---|---|---|---|---|
| 5,336,005 | A | * | 8/1994 | Moeck et al. | 401/68 |
| 5,879,093 | A | * | 3/1999 | Ohba | 401/68 |
| 5,884,638 | A | * | 3/1999 | Ohba | 132/318 |
| 6,244,769 | B1 | * | 6/2001 | Nakajima et al. | 401/75 |
| 6,334,729 | B1 | * | 1/2002 | Ohba | 401/68 |

FOREIGN PATENT DOCUMENTS

| | | |
|---|---|---|
| JP | 10-265825 | 6/1999 |

* cited by examiner

*Primary Examiner*—John J. Wilson
*Assistant Examiner*—Robyn Kieu Doan
(74) *Attorney, Agent, or Firm*—Rabin & Berdo, PC

(57) ABSTRACT

A spiral groove 11 is provided in a front cylinder 10, and a spiral piece 32 for constituting a cosmetic material retaining section 31 provided at a tip of a push rod 30 is located in the spiral groove 11 and retains a stick type cosmetic material A. A spiral engagement section 33 subsequent to the spiral piece 32 is engaged with the spiral groove 11 and constitutes a spiral engagement mechanism. An engagement line section 34 provided at an outer circumference of a stopper section 38 of the push rod 30 is engaged with a rotary stop groove 21 of a container body 20 and constitutes a rotary stop mechanism.

6 Claims, 9 Drawing Sheets

STICK TYPE COSMETIC MATERIAL FEEDING CONTAINER

BACKGROUND OF THE INVENTION

1. Field of the Invention

The present invention relates to a stick type cosmetic material feeding container which feeds out a stick type cosmetic material for use.

2. Description of the Related Art

Japanese Patent Laid-Open Publication No. Hei 11-146808 (JPA11-146808) shows a typical method for moving a stick type cosmetic material forward and backward by rotatably connecting a front cylinder and a container body, retaining the stick type cosmetic material at a cosmetic material retaining section which is provided at a tip of a push rod internally installed, and rotating the front cylinder and the container body described above. This method is shown as a conventional example in FIGS. 8 and 9.

In the stick type cosmetic material feeding container shown in FIG. 8, a front cylinder 231 and a container body cylinder 241 are connected coaxially and rotatably. A push rod 251 is installed therein. A cavity section 253 is provided at a tip of the push rod 251, and a stick type cosmetic material 233 is retained at the cavity section 253.

A longitudinal engagement groove 237 is formed in the front cylinder 231. Projections 257 formed on a surface of the push rod 251 are engaged with the engagement groove 237, thereby constituting a rotary stop mechanism. Further, on the side of the container body, the projections 257 are spirally engaged with a female screw section 245, thereby constituting a spiral engagement mechanism.

When the front cylinder 231 and the container body cylinder 241 are rotated in such a state, the push rod 251 advances while rotating synchronously with the front cylinder 231. Thus, the stick type cosmetic material starts projecting from a tip opening 235.

Further, in the stick type cosmetic material feeding container shown in FIG. 9, a female screw section 261 is provided at a base end of the front cylinder 231 An engagement groove 265 which is engaged with the projections 257 of the push rod 251 in a vertical direction constitutes a rotary stop mechanism in the container body cylinder 241. The female screw section 261 described above and the projections 257 of the push rod 251 which are spirally engaged with the female screw section 261 constitute a spiral engagement mechanism.

Thus, in FIG. 9, the push rod 251 and the front cylinder 231 are rotated relatively to each other and the stick type cosmetic material 233 advances while rotating with respect to the front cylinder 231.

However, in the stick type cosmetic material feeding containers shown in FIGS. 8 and 9, the stick type cosmetic material is retained at the tip cavity section 253 of the push rod 251. A space for the tip cavity section 253, which is equivalent to a thickness of the push rod 251, is provided in the front cylinder 231.

Therefore, when the stick type cosmetic material is, for example, warped due to heat or a change of dead weight, in FIG. 8, a load on the stick type cosmetic material is relatively light because the stick type cosmetic material advances without rotating in the front cylinder. However, when the front cylinder and the stick type cosmetic material advance while rotating relatively to each other as shown in FIG. 9, the stick type cosmetic material in a state of being warped comes into contact with an inner circumferential surface of the front cylinder while making a rotation, whereby the stick type cosmetic material is easily broken or chipped off.

As shown in FIG. 9, the stick type cosmetic material feeding container in which the stick type cosmetic material advances while rotating with respect to the front cylinder has the effect of creating a high-grade atmosphere by giving a molding core of lipstick a cubic effect. In particular, a stick type cosmetic material of a small bore diameter has an advantage of being three-dimensional for the reason described above, but such a stick type cosmetic material is hardly utilized under the existing circumstances.

SUMMARY OF THE INVENTION

An object of the present invention is to provide a stick type cosmetic material feeding container in which a stick type cosmetic material advances while rotating relatively to a front cylinder, but the stick type cosmetic material keeps standing up straight in the front cylinder. Thus, there is a lesser possibility that the stick type cosmetic material might be broken or chipped off at the time of use.

In order to achieve the object described above, a stick type cosmetic material feeding container according to the present invention comprises a front cylinder having an opening hole at its tip, a container body to be coaxially and rotatably connected to the front cylinder, a push rod which is provided in these front cylinder and container body and at the tip of which a cosmetic material retaining section for retaining a stick type cosmetic material is formed, a spiral engagement mechanism formed between the push rod and an inner circumference of the front cylinder, and a rotary stop mechanism formed between the push rod and the container body, wherein a feeding mechanism for causing the stick type cosmetic material to go in and out through the opening hole of the front cylinder by moving the push rod in an axial direction due to rotations of the front cylinder and the container body is provided, a spiral groove is formed at an inner circumference of the front cylinder so as to constitute the spiral engagement mechanism, and the cosmetic material retaining section is constituted by a spiral piece which extends in a helical shape from a tip of the push rod and is spirally engaged with the spiral groove.

In an aspect of the present invention, the spiral groove in the front cylinder comprises a single line of groove and also the spiral piece provided at a tip of the push rod comprises a single line of spiral piece with the same pitch as that of the spiral groove and a stick type cosmetic material is stored and retained in a space inside the spiral piece.

In another aspect of the present invention, the push rod is furnished with a spiral engagement section with the same pitch as that of the spiral piece in such a manner that the spiral engagement section is lined with the spiral piece provided at a tip of the push rod, and the spiral engagement section and the spiral groove of the front cylinder are spirally engaged, thereby constituting the spiral engagement mechanism described above.

In yet another aspect of the present invention, the push rod is furnished with a projection on an extension line of a spiral of the spiral piece which is provided at a tip of the push rod, and the projection and the spiral groove are spirally engaged, thereby constituting the spiral engagement mechanism described above.

In yet another aspect of the present invention, the length of the spiral groove in an axial direction which is provided in the front cylinder is set to be longer than a shifting stroke of the push rod.

In yet another aspect of the present invention, at an outer circumference of the spiral piece provided at a tip of the push rod, there are provided diameter expansion preventing means for preventing the expansion of an inside diameter of the cosmetic material retaining section which is in contact with a bottom of the spiral groove and is formed inside the spiral piece.

Thus, according to the present invention, in a kind of stick type cosmetic material feeding container in which a stick type cosmetic material core advances while rotating with respect to the front cylinder, since the spiral piece which constitutes the cosmetic material retaining section is engaged with the spiral groove of the front cylinder, the inside diameter of the cosmetic material retaining section, namely, a gap between the outside diameter of the stick type cosmetic material and an inner circumference of the front cylinder at which the spiral groove is formed can be extremely small. As a result, it is possible for the stick type cosmetic material to advance while sliding in the front cylinder with a minimum space left between the stick type cosmetic material and an inner circumferential surface of the front cylinder. Thus, it is possible to prevent an accident which may occur due to a warp of the stick type cosmetic material or the like.

Further, a line of spiral groove is formed in the front cylinder, and a line of spiral piece with the same pitch as that of the spiral groove to be spirally engaged with the spiral groove is formed at a tip of the push rod. Thus, it is particularly effective in making the pitch, which is a shifting distance at the time of a single rotation, smaller.

Further, the spiral engagement section constitutes the spiral engagement mechanism by engaging with the line of spiral groove of the front cylinder subsequently to the spiral piece at the time of rotations of the push rod and the container body. Therefore, no stress is imposed on the spiral piece other than a stress to support the stick type cosmetic material, thereby enabling the stick type cosmetic material to stably advance and retreat in the front cylinder.

Further, since a projection is installed on an extension line of the spiral piece which is provided at a piece of the push rod and constitutes the cosmetic material retaining section and the spiral engagement mechanism is constituted by spirally engaging the projection with the spiral groove provided in the front cylinder, it is comparatively easy to manufacture the push rod.

Further, preventing means are provided at an outer circumference of the spiral piece so that even though the stick type cosmetic material is inserted in the cosmetic material retaining section which is constituted by the spiral piece provided at a tip of the push rod, the inside diameter of the cosmetic material retaining section is not expanded more than its actual dimension. Thus, the inside diameter of the spiral piece will never be expanded more than the planned dimension.

Further, it is set such that the length of the spiral groove in an axial direction provided in the front cylinder is longer than a shifting stroke of the push rod. Therefore, even though the stick type cosmetic material is fed out up to the uppermost limit, the spiral piece provided at a tip of the push rod does not come into contact with a spiral termination at a tip of the front cylinder. Thus, it is possible to prevent that the spiral piece is deformed due to a load which may be on when the spiral piece comes into contact with the spiral termination and therefore the stick type cosmetic material comes off. Thus, the stick type cosmetic material can stably be retained.

DESCRIPTION OF THE PREFERRED EMBODIMENTS

A stick type cosmetic material feeding container according to the present invention will be described in detail with reference to the accompanying drawings.

Figure 1:
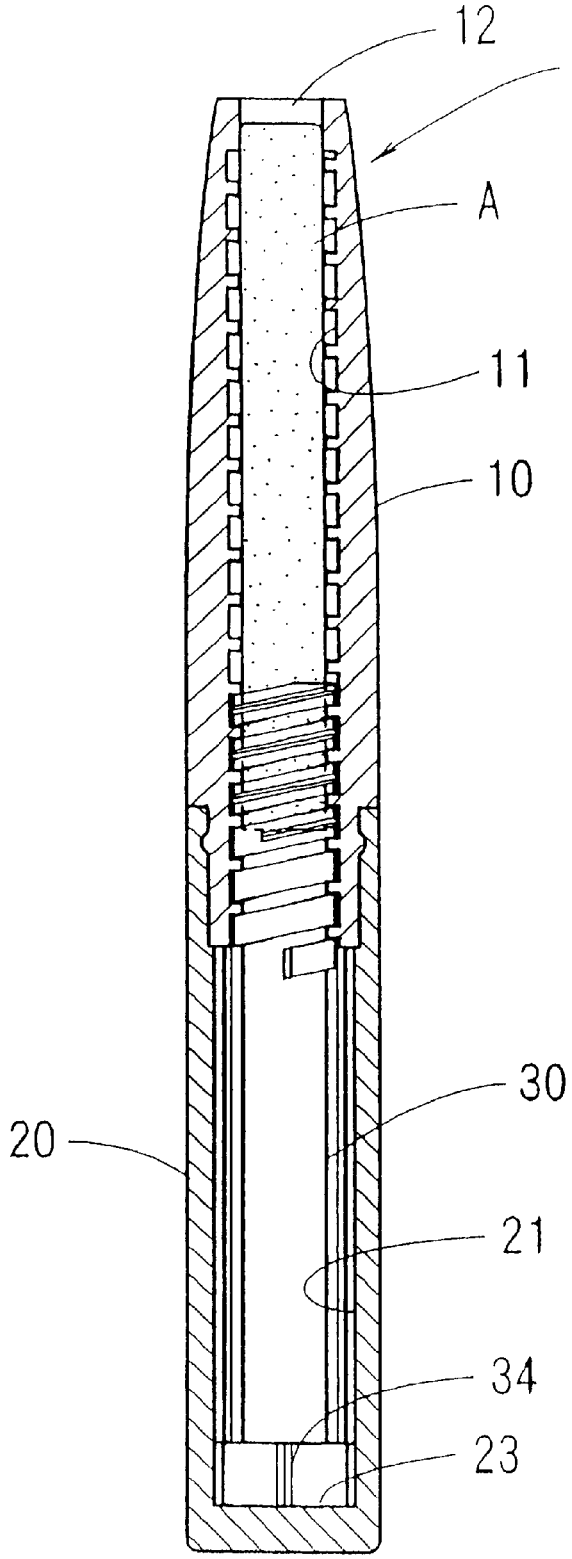
FIG. 1 is a sectional view showing a first embodiment of the present invention.
Figure 2:
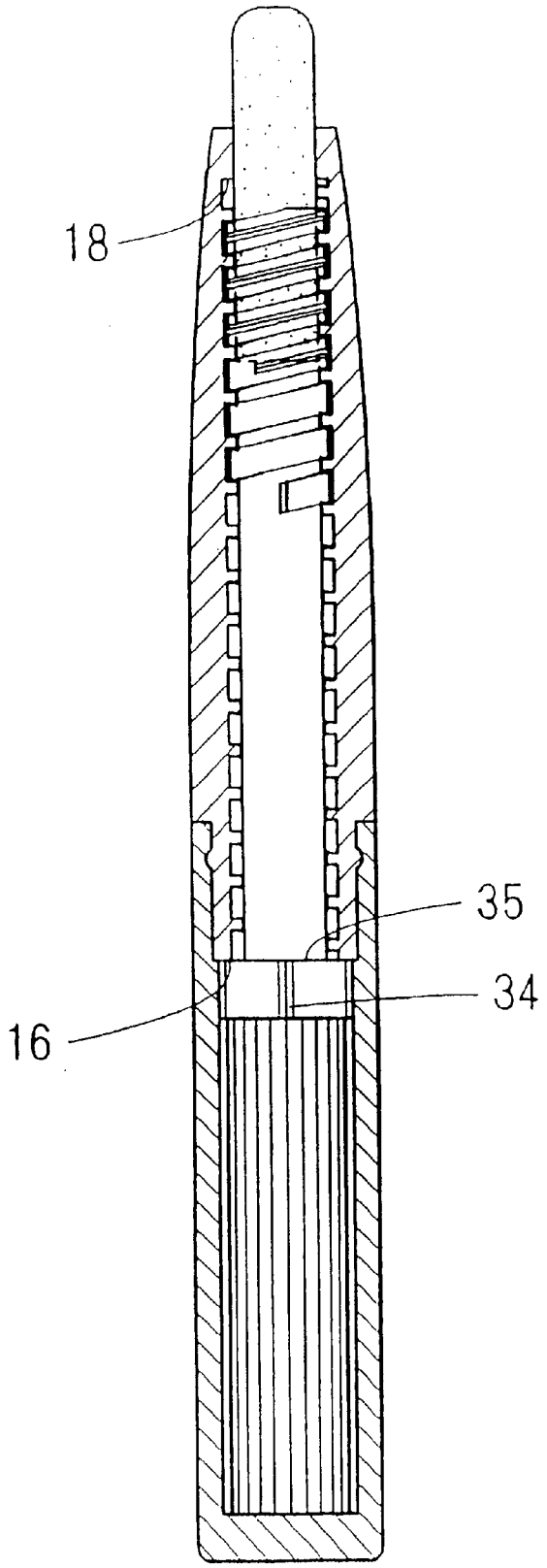
FIG. 2 is a sectional view showing the operating condition similarly.
Figure 3:
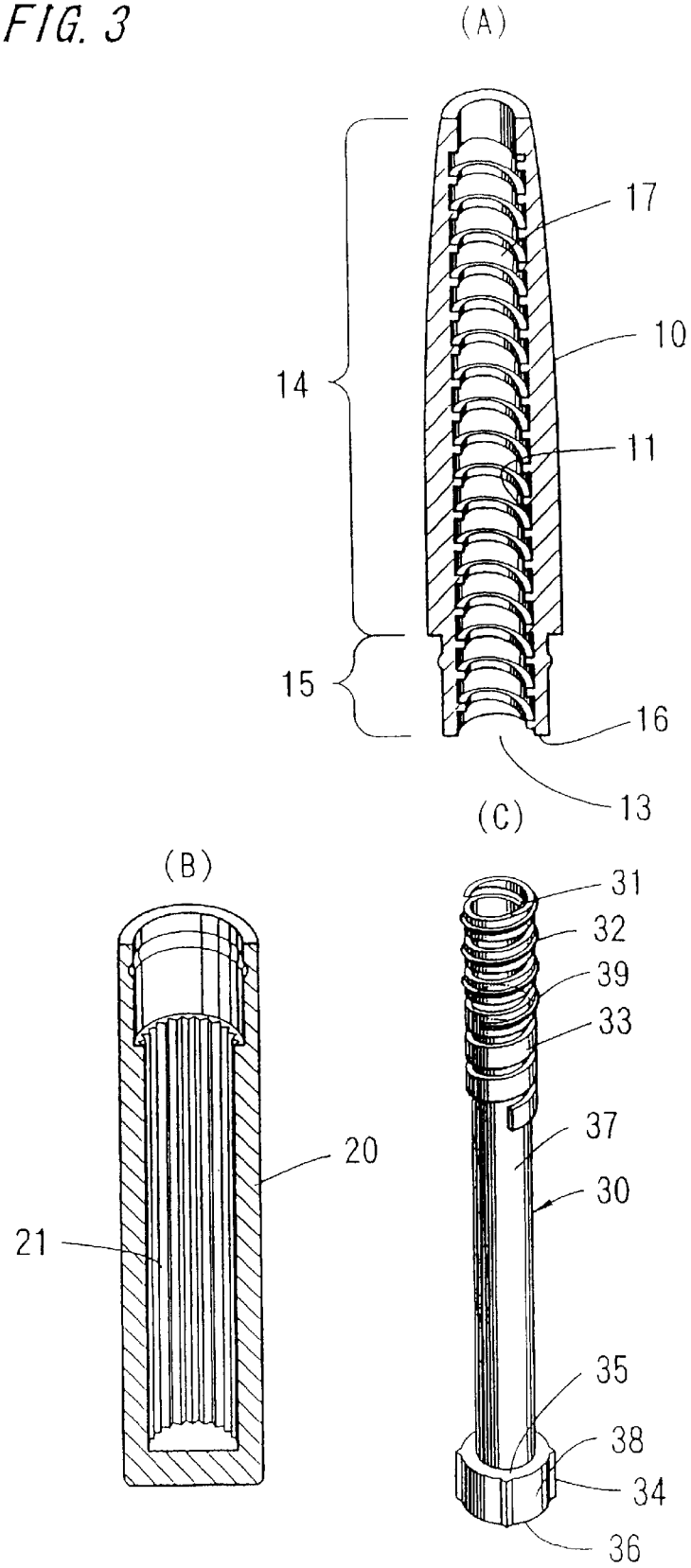
FIG. 3 is its exploded perspective view similarly.

FIG. 1 shows a stick type cosmetic material feeding container 1 according to a first embodiment and a position of the lowermost limit of a stick type cosmetic material A. FIG. 2 shows a state that the stick type cosmetic material A is fed out to the uppermost limit by a feeding mechanism. FIG. 3 is an exploded perspective view of each part.

The stick type cosmetic material feeding container 1 according to the present invention comprises each member shown in FIG. 3, namely, three members, such as a front cylinder 10, a container body 20, and a push rod 30.

The front cylinder 10 is a cylindrical body in which an inner circumferential surface of a tip opening hole 12 and an inner circumferential surface of a rear end opening hole 13 (FIG. 3) are almost same in size. The front cylinder 10 has a spiral groove 11 on its inner circumferential surface.

Further, an outside of the front cylinder 10 comprises a knob section 14 at a front part and a rotary section 15 at a rear part. The rotary section 15 is rotatably connected in the container body 20.

The container body 20 is a cylindrical body with a bottom. A longitudinal rotary stop groove(s) 21 is (are) provided in its inside.

With regard to the push rod 30 to be installed in the container body 20, a cosmetic material retaining section 31 which retains the stick type cosmetic material in a space of its inside is constituted by a spiral piece (thread) 32 extending in a spiral and helical shape from a front end of a bar shaft 37. A stopper section 38 is installed at a rear part of the push rod 30.

An engagement line section 34 provided at an outer circumference of the stopper section 38 is engaged with the rotary stop groove 21 provided in the container body 20, thereby constituting a rotary stop mechanism.

Therefore, in FIG. 1, the stick type cosmetic material A to be stored in the stick type cosmetic material feeding container 1 advances and retreats in a vertical direction while rotating synchronously with the container body 20 and also relative to the front cylinder 10.

In this case, since the internal threading spiral groove 11 is formed in the front cylinder 10 and the spiral piece 32 extending in a helical shape is situated in the spiral groove 11, a gap between an outer circumferential surface of the stick type cosmetic material A and an inner circumferential surface (a crest of internal thread ridge) of the front cylinder 10 which is between the respective adjoining upper spiral and lower spiral of the spiral groove 11 can be small. It is thus possible to retain the stick type cosmetic material A and cause it to slide with the minimum gap left between them, which is a feature of the present invention.

The present invention is further characterized in that the cosmetic material retaining section 31 which comprises the spiral piece 32 is manufactured in such a manner that the spiral piece 32 has the same pitch as that of the single spiral groove 11 of the front cylinder 10. Also, a spiral engagement section 33 to be spirally engaged with the spiral groove 11 is further installed at an outer circumferential surface of the bar shaft 37.

The spiral engagement section 33 is formed on the same spiral and with the same pitch as the spiral piece 32 of the push rod 30, and is disposed subsequent to the spiral piece 32.

Further, the length of the spiral engagement section 33 in an axial direction may be equivalent to the length of the push rod 30. If the spiral engagement section 33 is formed extending over the total length of the push rod 30 and used as a stick type cosmetic material feeding container which retains a thin stick type cosmetic material A, it will be effective in preventing the push rod 30 from twisting and the stick type cosmetic material A from breaking which may occur resulting from the twist of the push rod 30.

Based on FIG. 1 and FIG. 2, the operation of the stick type cosmetic material feeding container 1 will be described.

The front cylinder 10 fits in the container body 20 through the rotary section 15 of the front cylinder 10 so that they are rotatably connected.

The spiral piece 32 provided at a tip of the push rod 30 is stored in the single spiral groove 11 of the front cylinder 10. The spiral engagement section 33, which forms a helical line with the same pitch as that of the spiral piece 32, is engaged with the spiral groove 11, thereby constituting the spiral engagement mechanism. Further, the engagement line section 34 which is installed at an outer circumference of the stopper section 38 formed at a rear end of the push rod 30 is engaged with the rotary stop groove 21 provided in the container body 20, thereby constituting the rotary stop mechanism.

If the front cylinder 10 is rotated (normal rotation) with respect to the container body 20 in such a state, the push rod 30 installed in the stick type cosmetic material feeding container 1 will start rotating and advancing along the spiral groove 11 provided in the front cylinder 10, due to the feeding mechanism composed of the rotary stop mechanism on the side of the container body 20 and the spiral engagement mechanism on the side of the front cylinder 10. The stick type cosmetic material A retained by the spiral piece 32 provided at a tip of the push rod 30 will start projecting through the tip opening hole 12 of the front cylinder 10.

Further, if the front cylinder 10 is rotated, a state shown in FIG. 2 will arise. The feeding lowermost limit is defined when an upper end surface 35 of the stopper section 38 of the push rod 30 comes into contact with a lower end of the rear end opening hole 13 of the front cylinder 10.

On the other hand, if the front cylinder 10 is rotated reversely to the normal rotation, the stick type cosmetic material A will start retreating. When a state shown in FIG. 1 arises, in other words, when a lower end surface 36 of the stopper section 38 of the push rod 30 comes into contact with the container body 20, it is defined that the stick type cosmetic material A has reached the lowermost limit.

As described above, according to the present invention, in a kind of stick type cosmetic material feeding container in which the stick type cosmetic material A advances while rotating with respect to the front cylinder 10, since the spiral piece 32 which constitutes the cosmetic material retaining section 31 entirely fits in the spiral groove 11 of the front cylinder 10, the inside diameter of the cosmetic material retaining section 31, namely, a gap between the outside diameter of the stick type cosmetic material A and an inner circumference of the front cylinder 10 at which the spiral groove 11 is formed can extremely be small. As a result, it is possible for the stick type cosmetic material A to advance while sliding in the front cylinder with a minimum space left between the stick type cosmetic material A and an inner circumferential surface of the front cylinder 10. Thus, it is possible to prevent a nonconformity which may occur due to a warp of the stick type cosmetic material A or the like.

Incidentally, it is constituted such that in order for the spiral piece 32 at a tip of the push rod 30 not to come into contact with the spiral termination 18 of the front cylinder at the feeding uppermost limit shown in FIG. 2, the spiral groove 11 of the front cylinder 10 is set to be longer than a feeding stroke to shift the stick type cosmetic material A, whereby no load is on the spiral piece 32. Thus, durability of the spiral piece 32 is secured.

Further, an engagement line section 39 is installed at an outer circumference of the spiral piece 32, which constitutes the cosmetic material retaining section 31, in such a manner that the engagement line section 39 is projected. When the stick type cosmetic material A is inserted into the cosmetic material retaining section 31, the engagement line section 39 comes into contact with a slide surface (a bottom of the groove) 17 of the spiral groove 11 of the front cylinder 10, thereby taking steps to prevent the spiral piece 32 from expanding more than a planned inside diameter retaining dimension.

Whether a soft material or a hard material is used for the stick type cosmetic material depends on a part (eyelid, eyebrow, lip, and the like) to which the stick type cosmetic material is applied. Thus, in order to be reliably applicable to the stick type cosmetic materials having various levels of hardness, the engagement line section 39 will not be installed if it is not suitable for the material. The engagement line section 39 may be installed if a relatively soft material, such as a lip liner, is used. This enables secure retention of the core material.

Next, a stick type cosmetic material feeding container 101 according to a second embodiment of the present invention will be described with reference to FIGS. 4, 5, and 6.

Figure 4:
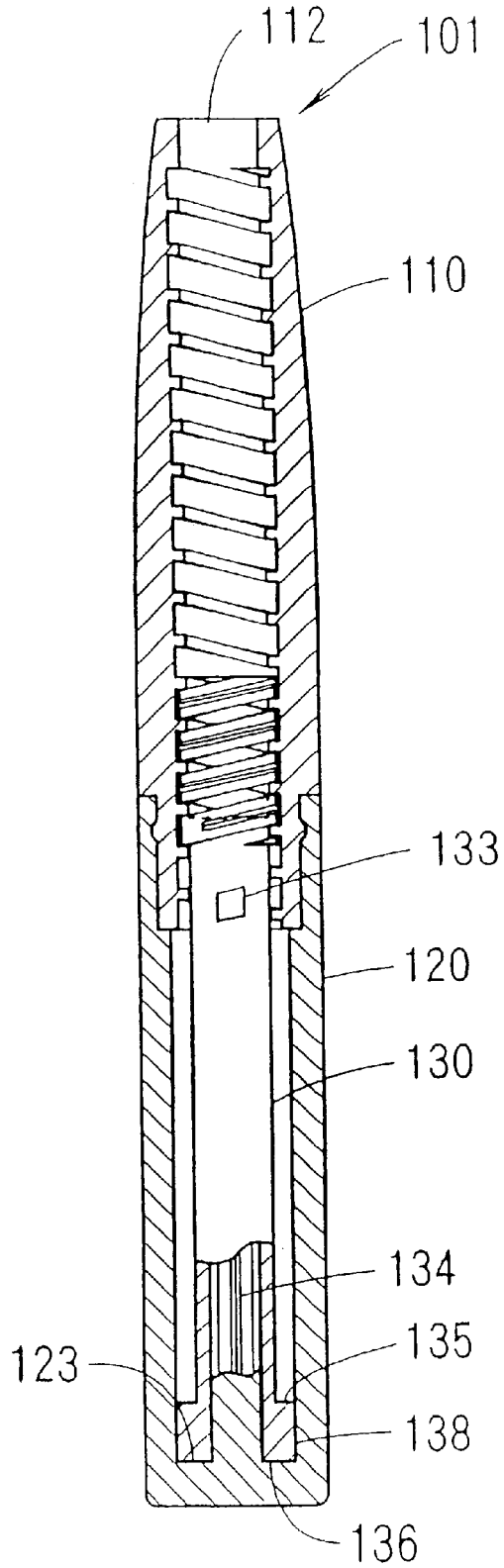
FIG. 4 is a sectional view showing a second embodiment of the present invention.

FIG. 4 shows a state that a push rod 130 is at the retreat limit. FIG. 5 shows a state that the push rod 130 is at the advance limit. FIG. 6 shows an exploded state of each part.

The stick type cosmetic material feeding container 101 comprises a front cylinder 110, a container body 120, a push rod 130, and the like similarly to the stick type cosmetic material feeding container 1 in FIG. 1, described above.

The difference between the stick type cosmetic material feeding container 1 shown in FIGS. 1 through 3 described above and the stick type cosmetic material feeding container 101 according to the second embodiment will subsequently be described.

Figure 6:
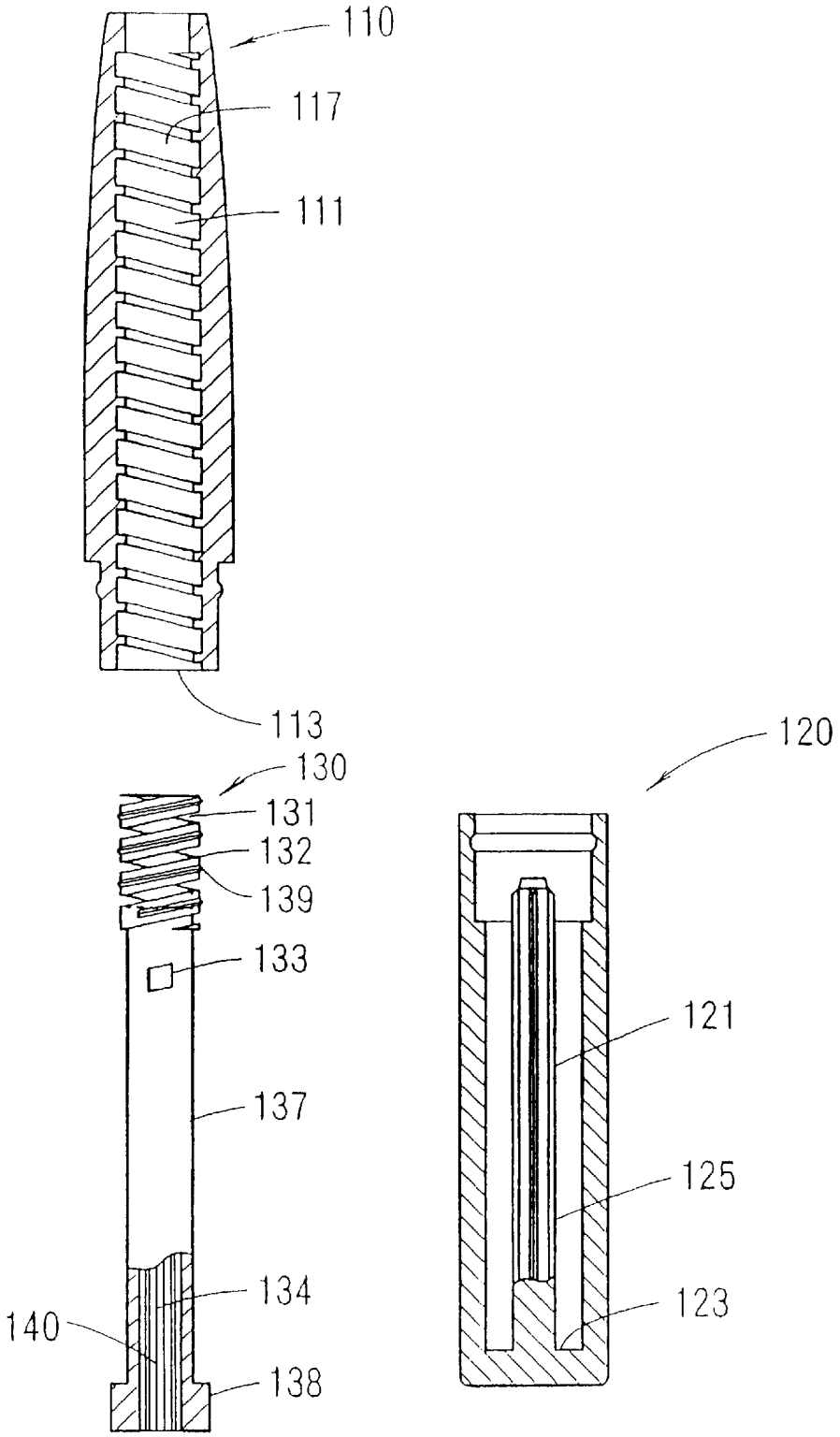
FIG. 6 is its exploded perspective view similarly.

With regard to the stick type cosmetic material feeding container 101 according to the second embodiment, as shown in FIG. 6, a bar shaft 125 is installed in a standing position on a bottom surface 123 of the container body 120. Further, a longitudinal rotary stop engagement line section 121 which is set to be longer than a length of a shifting stroke and causes the stick type cosmetic material A to feed out is installed on an outside surface of the bar shaft 125.

Further, a cavity section 140 is provided at a shaft center of the push rod 130, and an engagement line section 134 which is engaged with the rotary stop engagement line section 121 of the bar shaft 125 slidably in an axial direction and unrotatably is installed longitudinally in an axial direction on an inner circumferential surface of the cavity section 140. The rotary stop mechanism is constituted by the both.

Further, with regard to the tip of the push rod 130, a spiral piece 132 located in a spiral groove 111 of the front cylinder 110 constitutes a cosmetic material retaining section 131, and yet in order to constitute the spiral engagement mechanism, a projection (engagement section) 133 which is engaged with the spiral groove 111 and constitutes the feeding mechanism is installed on an extension line of a helical line of the spiral piece 132.

As described above, the stick type cosmetic material feeding container 101 of the second embodiment is different from that of the first embodiment in the shapes of the rotary stop mechanism and the spiral engagement mechanism.

Based on FIG. 4 and FIG. 5, the operation of the stick type cosmetic material feeding container of the second embodiment will be described.

The front cylinder 110 and the container body 120 are rotatably connected and the push rod 130 is installed therein.

The rotary stop engagement line section 121 which is formed at an outer circumferential surface of the bar shaft 125 installed on the bottom surface 123 of the container body 120 in a standing position and the engagement line section 134 which is formed in the cavity section 140 of the push rod 130 are engaged with each other and constitute the rotary stop mechanism in which the container body 120 and the push rod 130 synchronously rotate.

Further, the projection 133 is provided as the spiral engagement mechanism in a region on a helical line which is apart from the spiral piece 132 for retaining a tail section of a stick type cosmetic material (not shown in the drawings), and the spiral piece 132 is caused to be engaged with the spiral groove 111 provided in the front cylinder 110, thereby constituting the feeding mechanism.

If the front cylinder 110 is rotated with respect to the container body 120 in the state shown in FIG. 4, the push rod 130 will rotate synchronously with the container body 120 due to the rotary stop mechanism and will also move in an axial direction while rotating with respect to the front cylinder 110 on the side of the front cylinder 110 due to the spiral engagement mechanism.

Figure 5:
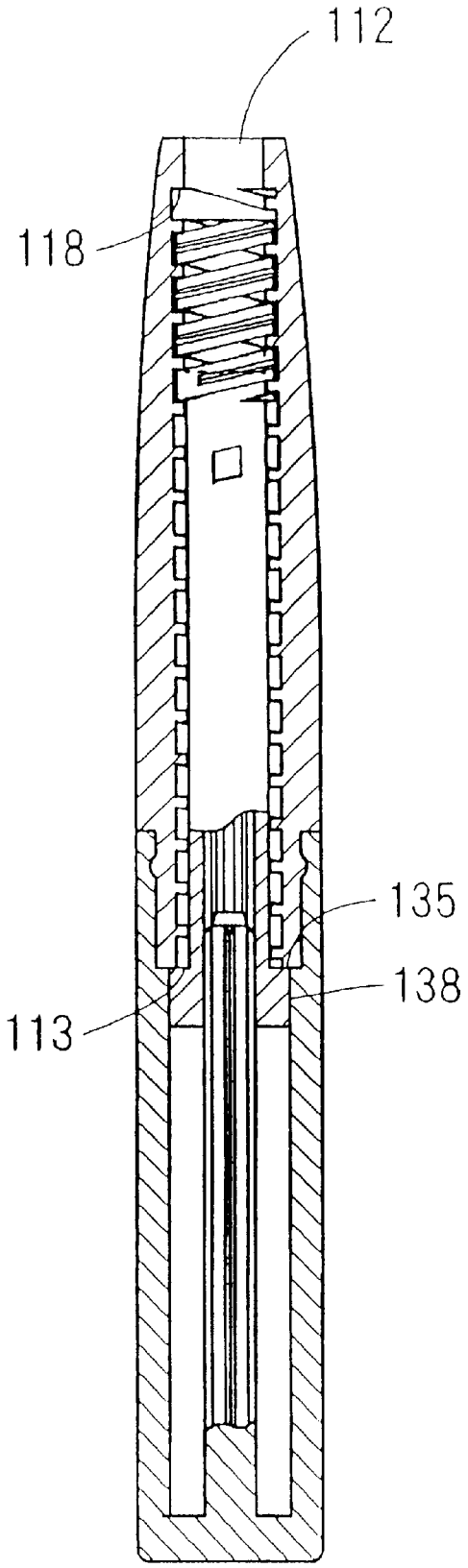
FIG. 5 is a sectional view showing the operating condition similarly.

If the rotation is continued further more, an upper end surface 135 of a stopper section 138 of the push rod 130 will come into contact with an edge of a rear end opening hole 113 of the front cylinder 110, whereby any further feeding cannot be carried out and the push rod 130 will reach the feeding uppermost limit shown in FIG. 5.

Due to the mechanism described above, when the front cylinder 110 is reversely rotated with respect to the container body 120, the push rod 130 starts descending, and when a lower end surface 136 of the push rod 130 comes into contact with the bottom surface 123 of the container body 120 as shown in FIG. 4, the lowermost limit is defined.

By providing the push rod 130 with the cavity section 140, the stick type cosmetic material feeding container 101 according to the second embodiment. Thus the second embodiment can be more suitable for a stick type cosmetic material having a thick diameter than the stick type cosmetic material feeding container 1 according to the first embodiment shown in FIG. 1 due to the following reason.

In terms of manufacturing efficiency, it is preferable that the push rod 130 is made of resin by plastic molding. However, if the stick type cosmetic material becomes thick, the diameter of the push rod 130 will be thick as a matter of course. Here, if a bar shaft 137 has a cross section of a large diameter, it will cause a sink mark or a deflection of the resin.

Thus, occurrence of the sink mark is prevented by installing the cavity section 140 and the rotary stop mechanism is provided by utilizing the cavity section 140.

Further, if the projection 133 which is located apart from the spiral piece 132 of the push rod 130 is adopted in the feeding mechanism, production of the push rod can be further facilitated.

Of course, the projection 133 is manufactured in such a manner that the projection 133 is spirally engaged with the spiral groove 111 of the front cylinder 110.

Incidentally, also in the second embodiment similarly to the first embodiment, it is constituted such that in order for the spiral piece 132 at a tip of the push rod 130 not to come into contact with a spiral termination 118 of the front cylinder 110 at the feeding uppermost limit in FIG. 5, the spiral groove 111 of the front cylinder 110 is set to be longer than the feeding stroke, whereby no load is on the spiral piece 132. Further, an engagement line section 139 is provided at an outer circumference of the spiral piece 132 which constitutes the cosmetic material retaining section 131 in such a manner that the engagement line section 139 is projected. When the stick type cosmetic material is inserted into the cosmetic material retaining section 131, the engagement line section 139 comes into contact with a slide surface (groove bottom) 117 of the spiral groove 111 of the front cylinder 110, thereby taking steps to prevent the spiral piece 132 from expanding more than a planned inside diameter retaining dimension.

Figure 7:
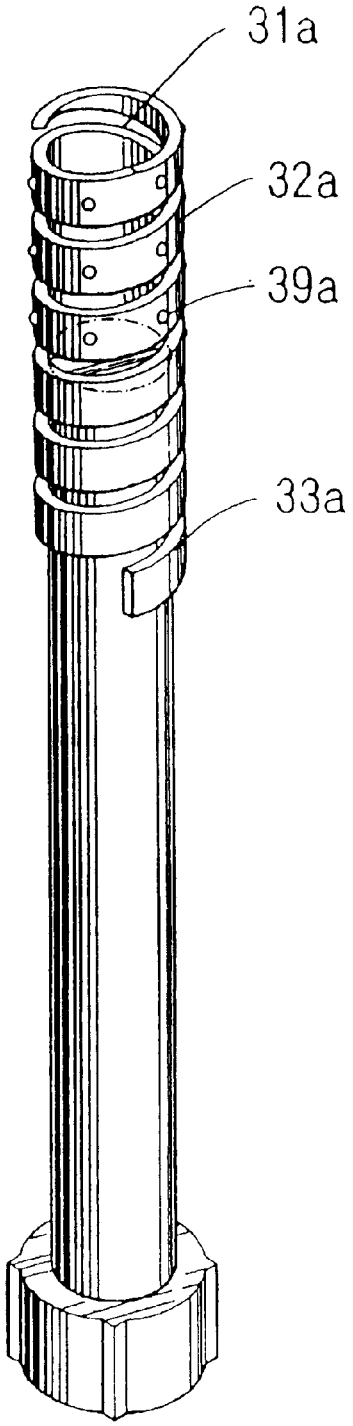
FIG. 7 is a perspective view showing another embodiment of a push rod.
Figure 7:
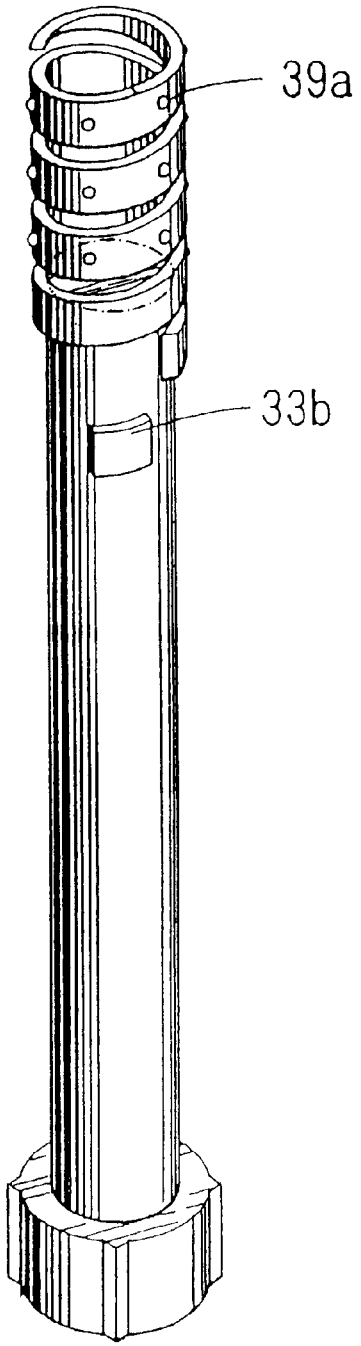
Figure 8:
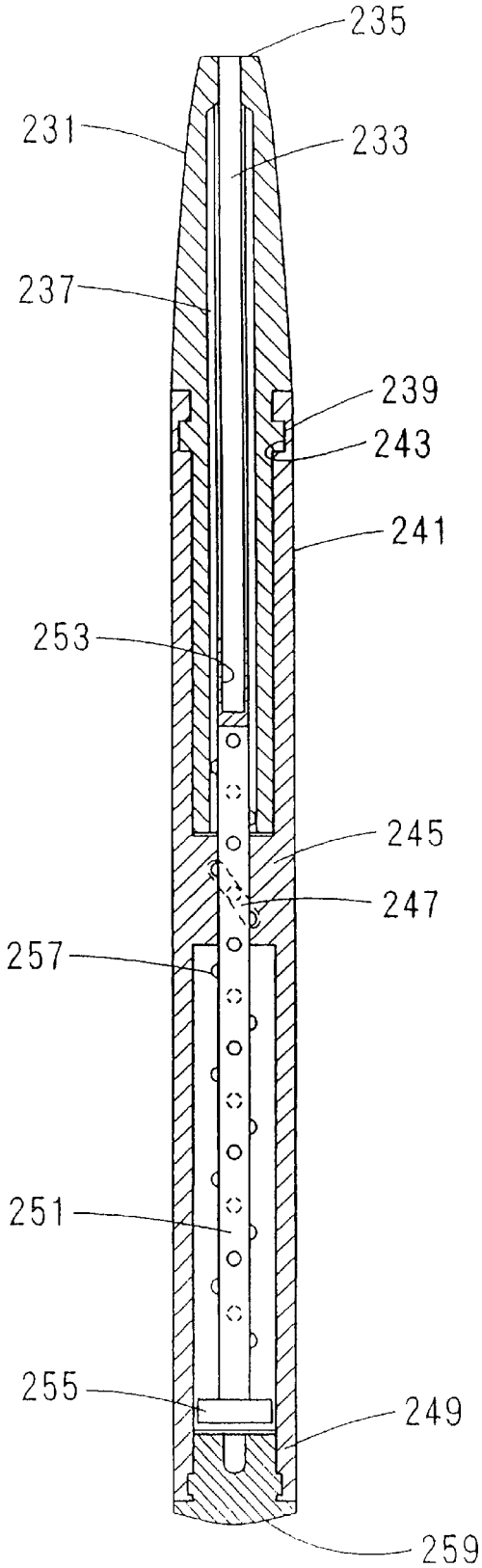
FIG. 8 Prior Art
FIG. 8 is a sectional view showing a conventional example.
Figure 9:
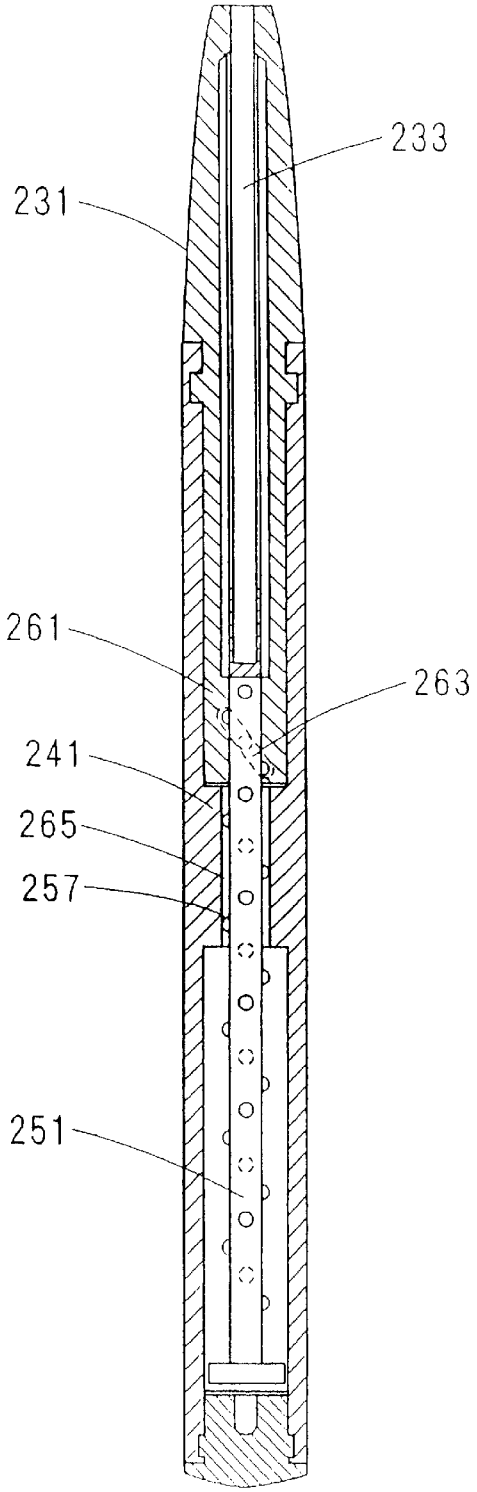
FIG. 9 Prior Art
FIG. 9 is a sectional view showing another conventional example.

Further, as shown in FIGS. 7(A) and 7(B), the engagement line sections 39 and 139 can be formed at outer circumferences of the spiral pieces 32 and 132 as a plurality of projections 39*a* and 139*a* to be intermittently arranged, respectively.

The present invention is not restricted to the embodiments described above and includes various modifications which can be made by a person having ordinary skill in the art within a scope of technical idea of the present invention.

What is claimed is:

1. A stick type cosmetic material feeding container, comprising:

a front cylinder having an opening hole at its tip;

a container body to be connected to the front cylinder coaxially and rotatably;

a push rod which is installed in the front cylinder and the container body, and having a cosmetic material retaining section formed at its tip; and a feeding mechanism which comprises a spiral engagement mechanism formed between the push rod and an inner circumference of the front cylinder, and a rotary stop mechanism formed between the push rod and the container body, the feeding mechanism causing the stick type cosmetic material to go in and out of the opening hole of the front cylinder by moving the push rod in an axial direction due to rotations of the front cylinder relative to the container body, wherein a spiral groove is formed at the inner circumference of the front cylinder so as to constitute the spiral engagement mechanism, and the cosmetic material retaining section is constituted by a spiral piece which extends helically from the tip of the push rod and is engaged with the spiral groove.

2. A stick type cosmetic material feeding container according to claim 1, wherein the spiral groove in the front cylinder is a single groove, and the spiral piece at the tip of the push rod is a single spiral piece with a same pitch as that of the spiral groove, and the stick type cosmetic material is stored and retained in a space inside the spiral piece.

3. A stick type cosmetic material feeding container according to claim 1, wherein a spiral engagement section with a same pitch as that of the spiral piece is disposed on the push rod subsequent to the spiral piece, and the spiral engagement mechanism is further constituted by spiral engagement of the spiral engagement section and the spiral groove of the front cylinder.

4. A stick type cosmetic material feeding container according to claim 1, wherein the push rod is furnished with a projection on an extension line of a spiral of the spiral piece, and the projection and the spiral groove are spirally engaged so as to constitute the spiral engagement mechanism.

5. A stick type cosmetic material feeding container according to claim 1, wherein a length of the spiral groove in an axial direction is set to be longer than a shifting stroke of the push rod.

6. A stick type cosmetic material feeding container according to claim 1, wherein diameter expansion preventing means for preventing an expansion of an inside diameter of the cosmetic material retaining section, is in contact with a groove bottom of the spiral groove and is provided at an outer circumference of the spiral piece.

* * * * *